US006490431B2

(12) United States Patent
Takahashi et al.

(10) Patent No.: US 6,490,431 B2
(45) Date of Patent: Dec. 3, 2002

(54) FIXING ROTATABLE MEMBER FOR HEAT FIXING DEVICE AND FIXING DEVICE USING THE SAME

(75) Inventors: Koji Takahashi, Toyokawa (JP); Tetsuro Ito, Anjo (JP); Mitsuru Isogai, Aichi-Ken (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/825,338

(22) Filed: Apr. 4, 2001

(65) Prior Publication Data

US 2001/0028818 A1 Oct. 11, 2001

(30) Foreign Application Priority Data

Apr. 5, 2000 (JP) ..... 2000-102938
May 10, 2000 (JP) ..... 2000-136540

(51) Int. Cl.[7] ..... G03G 15/20
(52) U.S. Cl. ..... 399/333; 399/330; 430/124
(58) Field of Search ..... 399/22, 324, 328, 399/329, 330, 331, 333; 430/99, 124

(56) References Cited

U.S. PATENT DOCUMENTS 4,075,390 A * 2/1978 Murphy ..... 430/124 X
5,157,445 A * 10/1992 Shoji et al. ..... 399/331 X
5,177,552 A 1/1993 Isogai et al.
5,250,996 A * 10/1993 Sugizaki et al. ..... 430/124 X
5,287,153 A * 2/1994 Senba ..... 399/324
5,327,202 A 7/1994 Nami et al.
5,395,725 A * 3/1995 Bluett et al. ..... 430/124
5,471,288 A * 11/1995 Ohtsuka et al. ..... 399/324 X
5,608,508 A 3/1997 Kumagai et al.
5,717,988 A 2/1998 Jinzai et al.
5,966,578 A * 10/1999 Soutome et al. ..... 399/333

* cited by examiner

*Primary Examiner*—Sandra Brase
(74) *Attorney, Agent, or Firm*—Morrison & Foerster LLP

(57) ABSTRACT

The heat fixing device includes a heating roller and a pressure roller disposed in contact with the heating roller, the heating roller includes a base member and a surface layer, and the surface layer has a surface resistivity of $1\times10^{16}$ Ω or lower, and a residual elongation percentage of 3% or lower. By this arrangement, charging of the heating roller can be prevented so that the recording medium can be prevented from being curled around the heating roller.

24 Claims, 4 Drawing Sheets

FIXING ROTATABLE MEMBER FOR HEAT FIXING DEVICE AND FIXING DEVICE USING THE SAME

BACKGROUND OF THE INVENTION

This application is based on applications No. 2000-102938 and 2000-136540 filed in Japan, the contents of which are hereby incorporated by reference.

1. Field of the Invention

This invention relates to a fixing device used in an image forming apparatus such as electrophotographic copying machine, a printer and the like and a fixing rotatable member therefor, that is, a heating roller and a pressure roller.

2. Description of the Related Arts

In the electrophotographic image forming apparatus such as a copying machine, a printer, a facsimile and the like, light according to an image is applied to a charged photosensitive member to form an electrostatic latent image according to the image. Toner is electrostatically adsorbed to the electrostatic latent image to be developed. The developed toner image is electrostatically transferred and adsorbed to a recording medium (or once to a toner image carrier, and then from the toner image carrier onto a recording medium). When the recording medium to which the toner image is electrostatically adsorbed passes through a fixing device, normally heat and pressure are applied to the toner image to be fixed to the recording medium. This electrophotographic image forming apparatus is well known, so the further description will be omitted.

FIGS. 1, 2 and 3 show an example of a fixing device for explaining the prior art and the embodiments of the invention. FIG. 1 is a sectional view for giving an outline of a fixing device, and FIGS. 2 and 3 are respectively a partial sectional view of a heating roller and a partial sectional view of a pressure roller, which are used in the fixing device of FIG. 1.

The fixing device 1 has a heating roller 2 and a pressure roller 3, and the pressure roller 3 has a cylindrical core member 31 made of rigid material such as metal or the like and a thin silicone rubber surface layer 32 on the outer surface thereof. The pressure roller 3 is pressed toward the heating roller 2 by an energizing member such as a spring 6 or the like. A recording medium 4 to which toner 5 is electrostatically adsorbed is transported in the direction of an arrow (c) from the left in the drawing. The heating roller 2 has a cylindrical core member made of metal such as aluminum and an elastic layer 9 on the periphery thereof. The interior of the core member 8 is provided with a heater 7, and the heating roller 2 is driven to rotate in the direction of an arrow (a) by a driving source not shown. The pressure roller 3 is rotated in the direction of an arrow (b), following the rotation of the heating roller 2.

When the heating roller 2 is subjected to the pressure of the pressure roller 3, the elastic layer 9 is mainly deformed to form a nip part (n) having a width. When the transported recording medium 4 passes through the nip part (n), the recording medium 4 is subjected to sufficient heat and pressure, so that the melted toner 5 enters between fibers of the recording medium 4.

The elastic layer 9 of the heating roller 2 is, as shown in FIG. 2, formed by three layers. The lowermost layer 91 coming into contact with the aluminum core member 8 is made of comparatively thick silicone rubber. An intermediate layer 92 coming into contact with the lowermost layer 91 has oil resistance, and is made of fluoro-rubber, for example. The intermediate layer 92 may be further formed by plural layers. A surface layer 93 coming into contact with the intermediate layer 92 is made of comparatively thin silicone rubber impregnated with silicone oil, and positioned on the outermost side of the heating roller 2.

The silicone rubber used as material of the surface layer 93 of the heating roller 2 and the surface layer 32 of the pressure roller 3 normally presents insulating property with the surface resistivity of $10^{16}\Omega$ or higher. Therefore, the surface layers 93 and 32 show a very large negative charging characteristic at the time of coming into contact with and separating from the recording medium 4 to generate static electricity.

When the recording medium 4 passes through the fixing device 1, the recording medium is strongly sucked to the heating roller 2 and the pressure roller 3 by the generated static electricity. Consequently, encountered is the problem that the recording medium 4 is curled around the rollers 2,3 to cause a jam.

A known technique for solving the problem is such that a conductive filler is added to the lowermost layer 91 of the heating roller 2 or the surface layer 32 of the pressure roller 3, whereby the surface resistivity of the silicone rubber is adjusted to $10^{12}\Omega$ or lower so that the generated charges are released to the core member 8 or 31 to prevent curling of the recording medium 4.

The surface layer 93 of the heating roller 2 directly comes into contact with toner on the recording medium 4. Though it is desirable that all of toner is fixed on the recording medium 4 by fixing, actually some of toner transfers and adheres to the surface layer 93 of the heating roller 2. This is the so-called toner offset phenomenon. To prevent this toner offset, a lubricant is further added to the surface layer 93. In the color copying machine and the color printer, the surface lubricating performance is especially thought important, so a comparatively large amount of a lubricant is added.

Further, as the surface layer 93 of the heating roller 2 and the surface layer 32 of the pressure roller 3 are repeatedly deformed and loosened, and further heated to a high temperature, they are rapidly deteriorated. An additive for preventing such deterioration is further added to the surface layers 93 and 32.

Since these kinds of additives have a tendency of mutually restraining individual properties, and from a viewpoint of keeping up strength and elasticity, a large quantity of additives can not be added to silicone rubber of the surface layers 93 and 32, it is very difficult to select the quantity of the above additives of many kinds and the combination of kinds.

SUMMARY OF THE INVENTION

This invention has been made to overcome the above disadvantages and provides a fixing rotatable member improved in conductive property, surface lubricating property, curling preventing performance and deterioration resistance to be well-balanced. Further, the invention provides a heat fixing device using an improved fixing rotatable member.

In the specification of this invention , the residual elongation percentage is defined as follows. A sample having an original length $L_O$ is elongated by applying force (tensile stress) to the sample so that a length of the elongated sample becomes 1.5 times as long as the original length $L_O$. After that, when the applied force is made zero, the sample shrinks to reach a length L. The residual elongation percentage is $(L-L_O)/L0$, and expressed by %.

The fixing rotatable member used in the heating fixing device of the invention includes a base member and a surface layer, and the surface layer has a surface resistivity of $1\times10^{16}\Omega$ or lower and a residual elongation percentage of 3% or lower. The surface layer may contain dimethyl silicone rubber or phenyl denatured silicone rubber as elastic material. Further, wet-type silica may be contained in the surface layer. Further, silicone oil may be contained in the surface layer. Further, the base member may be formed by the metallic core member and a first elastic layer on the outside thereof. Further, silicone rubber or fluorine containing rubber may be used in the first elastic layer. Further, the base member has a second elastic layer on the outside of the first elastic layer, and the second elastic layer may be formed of fluorine containing rubber.

Other objects and advantages besides those discussed above shall be apparent to those skilled in the air from the description of a preferred embodiment of the invention which follows. In the description, reference is made to accompanying drawings, which form a part thereof, and which illustrate an example of the invention. Such example, however, is not exhaustive of various embodiments of the invention, and therefore reference is made to the claims which follow the description for determining the scope of the invention.

BRIEF DESCRIPTION OF THE DRAWINGS

The accompanying drawings, which are incorporated in and constitute a part of the specification, illustrate embodiments of the invention and together with the description, serve to explain the principles of the invention.

DESCRIPTION OF THE PREFERRED EMBODIMENTS

Figure 1:
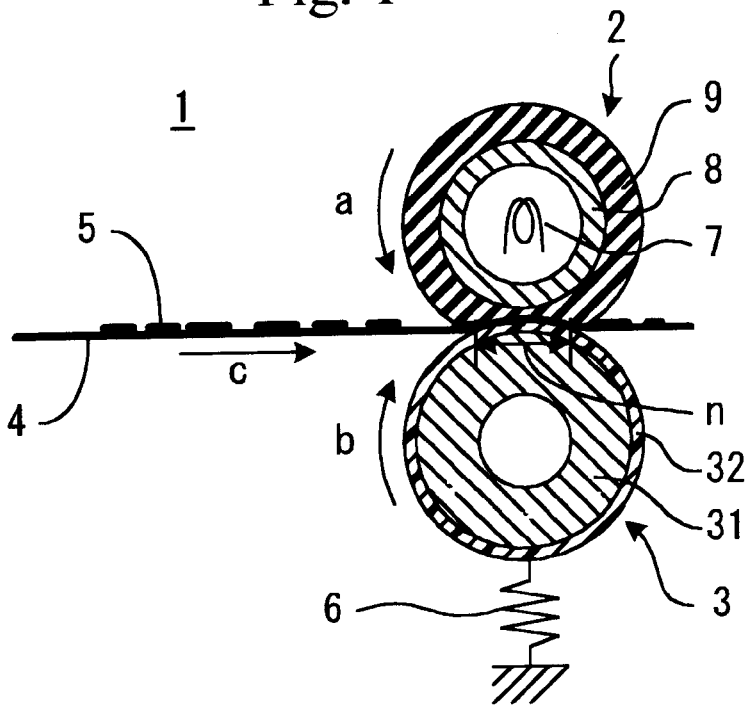
FIG. 1 is an example of a sectional view of a fixing device for explaining the prior art and the embodiment of the invention.
Figure 2:
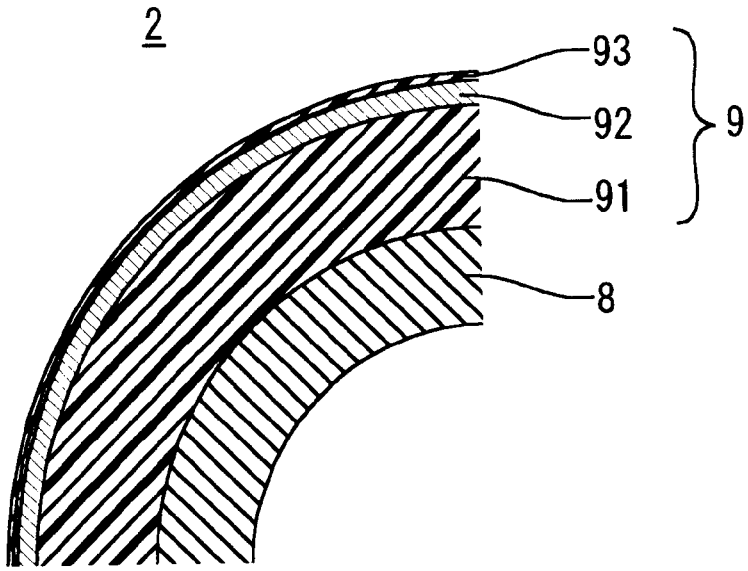
FIGS. 2 and 3 are respectively partial sectional views of a heating roller and a pressure roller used in the fixing device shown in FIG. 1.
Figure 3:
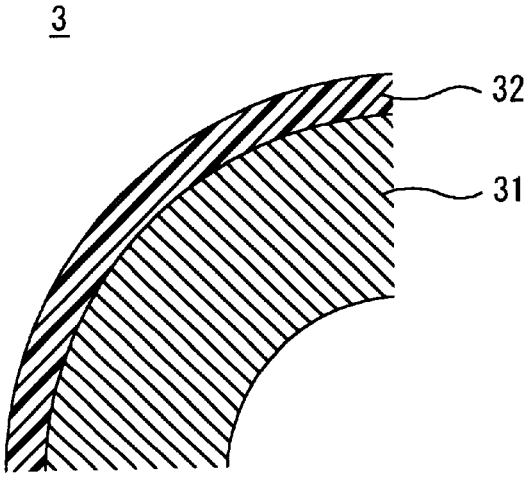

FIGS. 1, 2 and 3, and the description using these drawings are common to the present embodiment, so the repeated description on the outline of the heat fixing device 1, the heating roller 2 and the pressure roller 3 is omitted. The heating roller 2 has a lowermost layer 91, an intermediate layer 92 and a surface layer 93 on the periphery of a core member 8. The lowermost layer 91 has a comparatively large thickness, and is formed of silicone rubber to which conductive filler is added. The intermediate layer 92 is a layer having oil resistance made of fluorine containing rubber, and is formed by a single or plural layers. As mentioned later, the surface layer 93 is formed of dimethyl silicone rubber impregnated with silicone oil. The dimethyl silicone rubber is excellent in respect to surface lubrication and heat resistance.

Since static electricity is generated by contact and separation between a recording medium 4 and a heating roller 2, the heating roller 2 is charged to certain potential. When the potential is higher, the recording medium 4 is electrostatically sucked to the heating roller 2 and easy to be curled around the roller. Therefore, as mentioned later, material having a low charging potential is used for the surface layer 93.

Figure 4:
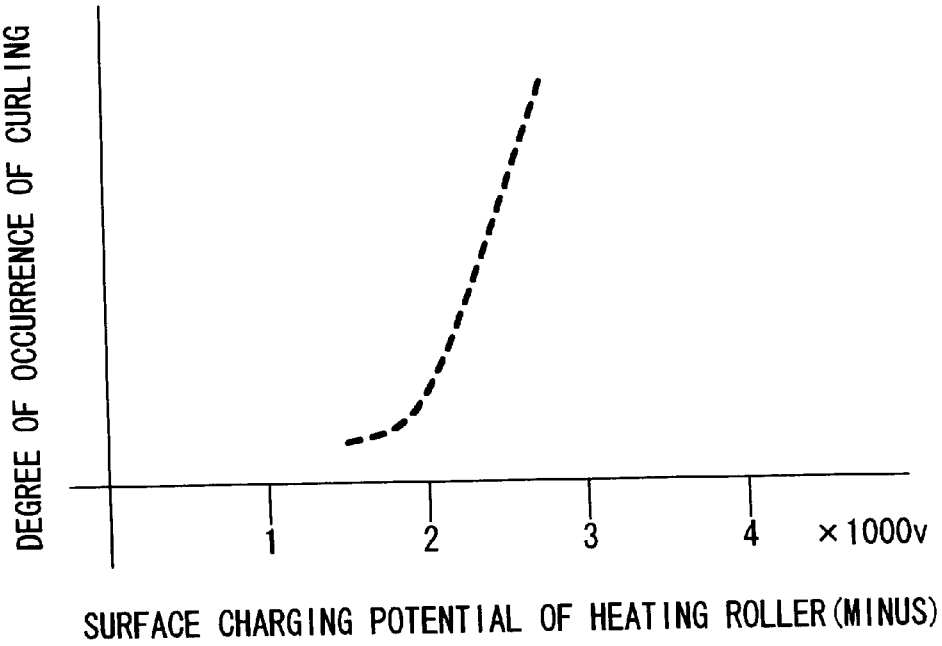
FIG. 4 is a graph showing the charging potential of the surface layer of the heating roller and the degree of occurrence of curling.

FIG. 4 graphically shows the surface charging potential of the surface layer 93 of the heating roller 2 and the degree of occurrence of curling according to the experience. It is preferable that the degree of occurrence of curling is zero, but it is known that in the case where the charging potential is about 2000 volt or lower, there is no practical obstacle.

Figure 5:
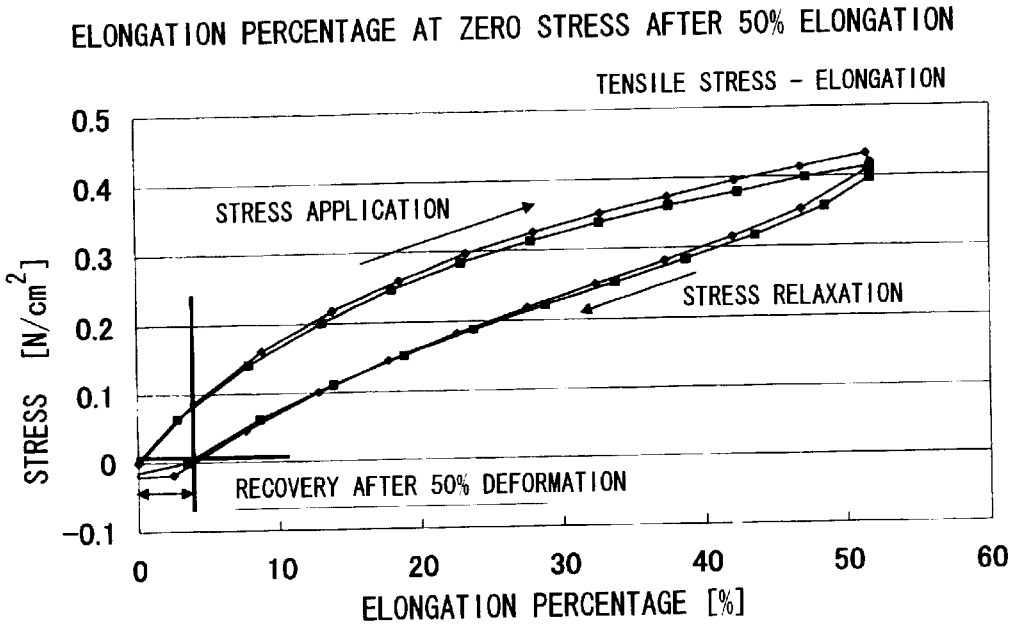
FIG. 5 is a hysteresis curve showing the relationship between the elongation percentage (%) of silicone rubber and the stress (N)

Most of elastic materials have the property that when force (stress) is applied to the material to be elongated, and the applied force is released, it will not be restored to the original length. The relationship between the force and the elongation at this time is different between the application of force and the release of the force. The silicone rubber has such property. FIG. 5 is a graph (hysteresis curve) generated by plotting the relationship between the elongation percentage (%) and stress (N) observed when tensile stress (N: newton/$cm^2$) is applied to silicone rubber of different components up to the elongation percentage of 50% and after that, the stress is relaxed. The hysteresis curve is varied depending on the components of silicone rubber, so the previously defined residual elongation percentage is varied.

Figure 6:
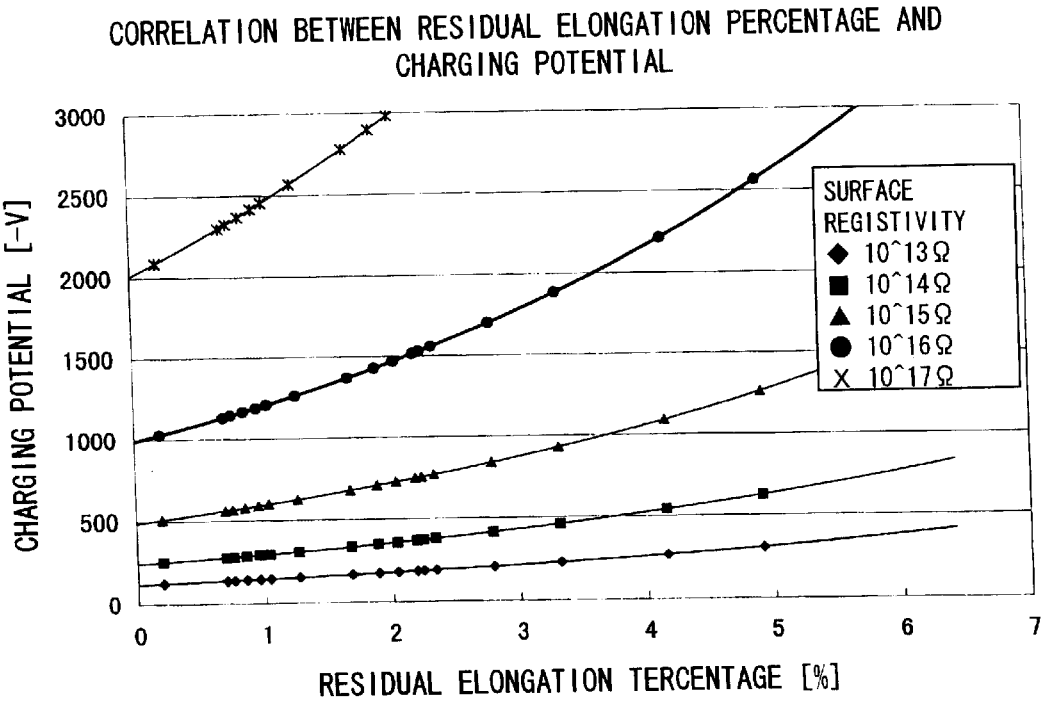
FIG. 6 is a graph generated by plotting the correlation of the residual elongation percentage and the charging potential concerning the dimethyl silicone rubber different in elongation percentage.

FIG. 6 is a graph generated by plotting the relationship between the residual elongation percentage and the charging potential concerning the dimethyl silicone rubber different in residual elongation percentage. It is known from this graph that the residual elongation percentage and the charging potential of the dimethyl silicone rubber have positive correlation, and further, when material having a residual elongation percentage exceeding 3% is used, the charging potential easily exceeds 2000 volt. As described above, when the material having the charging potential exceeding 2000 volt is used for the surface layer 93 of the fixing rotating member, curling possibility of the recording medium 4 around the fixing rotating member is increased. That is, in order to prevent the recording medium 4 from curling on the heating roller 2, as the material for the surface layer 93, it is effective to use the material showing the residual elongation percentage of 3% or lower.

The above residual elongation percentage is measured by the following method. Silicone rubber (2 mm thick, L18 rubber manufactured by Shin-etsu Co., Ltd.) as a sample is died out into a dumb-bell No. 3 form used in JIS K6251 test method (tensile strength test for vulcanized rubber, and load is applied thereto by a push-pull stand (simplified load tester, SV-5, manufactured by IMADA Co., Ltd.) to measure the stress by a digital force gauge (a load cell capable of measuring to ±5 Kg, DPX-5T, manufactured by IMADA Co., Ltd.). The sample elongation amount at this time is measured from the displacement of the push-pull stand by a displacement sensor (a laser displacement sensor, LB-01, LB-60, manufactured by Keyence Corp.). The measurement data on these stress and elongation amount is taken in personal computer by an A/D converting card (PC card type data collection system, NR-250, manufactured by Keyence Corp.) and analyzed on Excel (trade name). The measurement conditions at this time are as in the following. That is, the elastic stress rate is 1.29 mm/sec (since the deformation is instantaneous because of a heating roller, the speed adjust knob scale of the push-pull stand is 30, which is highest), the elongation percentage of the sample is 50% relative to the sample length (elongated by 31 mm relative to the sample length of 62 mm), and the hold time (sample tension 50% keep time) is 90 sec.

Figure 7:
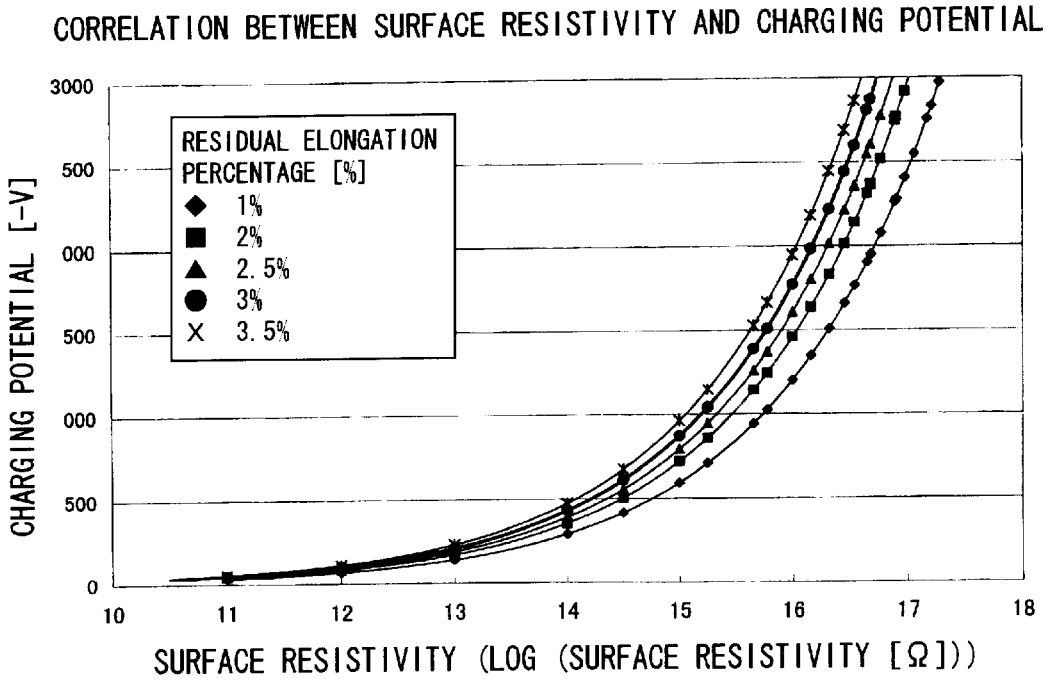
FIG. 7 is a graph generated by plotting the correlation of the surface resistivity and the charging potential concerning silicone rubber different in surface resistivity.

FIG. 7 is a graph generated by plotting the correlation of the surface resistivity and the charging potential concerning the silicone rubber different in surface resistivity. It is known that the positive correlation is found between the surface resistivity and the charging potential, and in the material having the surface resistivity of $10^{16}\Omega$ or higher, the charging potential easily exceeds 2000 volt. Accordingly, it is effective for preventing the occurrence of curling to use silicone rubber having a surface resistivity not exceeding $10^{16}\Omega$ for the surface layer 93. The surface resistivity is measured by JIS K6911 measuring method. This measurement method is for thermo-setting plastic, but there is no substantial problem in measuring the surface resistivity of silicone rubber by this measuring method.

To meet the above conditions at the same time, that is, to always keep the charging potential 2000 volt or lower, dimethyl silicone rubber or phenyl modified silicone rubber adjusted so that the residual elongation percentage is 3% or lower, and the surface resistivity ranges from $10^{12}\Omega$ to $10^{16}\Omega$ is used in the surface layer 93 of the heating roller 2 according to the invention. Especially, when dimethyl silicone rubber being composed of straight chain dimethyl polysiloxane terminated vinyl groups as main component is used, favorable result could be obtained in the surface lubrication.

To adjust these characteristics, a very small quantity of carbon black is added to the surface layer 93 within a range of not impairing the surface resistivity and surface lubrication. The carbon black is added in such a range to maintain the effect of heat resistance and low chargeability, that is, ranging from 0.1 wt % to 5 wt %. Further, when as a filler for the surface layer 93, dry-type silica ($SiO_2$), wet-type silica ($SiO_2$ $nH_2O$) or a mixture thereof is used, favorable result is obtained. Silica is combined with siloxane to exert an influence on the strength and thermal conductivity of silicone rubber. The wet-type silica largely contributes to conductivity, and is effective for low chargeability, and the dry-type silica has a large effect of reinforcement to heighten heat resistance. Further, the surface layer 93 may be impregnated with silicone oil.

The reason why the surface resistivity is set to $10^{12}\Omega$ or higher is that when it is smaller than the value, surface lubrication is impaired, so it is difficult to actually use the roller as a fixing device.

For the surface layer 93 of the heating roller 2, as described above, used is dimethyl silicone rubber, especially, the dimethyl silicone rubber being composed of straight chain dimethyl polysiloxane terminated vinyl groups as main component, and the filler adjusts the residual elongation percentage to 3% or lower, and the surface resistivity ranging from $10^{12}\Omega$ to $10^{16}\Omega$, so that even in the environment of high humidity, the surface of the heating roller 2 is kept to the charging potential of 2000 volt or lower. Thus, the recording medium 4 can be prevented from being curled around the heating roller 2.

Further, according to the invention, a coating layer 32 of the pressure roller 3 is subjected to component adjustment. For the coating layer 32, used is dimethyl silicone rubber being composed of straight chain dimethyl polysiloxane terminated vinyl groups as main component, which is the same as that of the surface layer 93, but as an additive, they use different kinds of additives. When wet-type silica is used as an additive to the surface layer 93 of the heating roller 2, dry-type silica is used as an additive to the coating layer 32 of the pressure roller 3. The residual elongation percentage of the surface layer 93 of the heating roller 2 is set to a value smaller than that of the coating layer 32 of the pressure roller 3. These are set for the following reasons.

Unlike the pressure roller 3, the heating roller 2 directly comes into contact with toner to be fused, thereby directly forming the surface of a toner image, so the thermal load is larger than that of the pressure roller in design. Since the formed image surface comes into contact with the surface layer 93 of the heating roller 2, the recording medium 4 is more liable to be curled around the heating roller as compared with the pressure roller by charging. As there are many kinds of recording media 4, the charging status of the heating roller 2 and the pressure roller 3 varies with the kind of the recording medium. Even in the case of using any kind of recording medium 4, the heating roller 2 is more hardly charged than the pressure roller 3, so that more stable fixing can be performed.

Accordingly, for the same reason, the quantity of carbon black added to the surface layer 93 of the heating roller 2 is made larger than the quantity of carbon black added to the surface layer 32 of the pressure roller, whereby the heating roller 2 is made harder to be charged than the pressure roller 3 so that fixing can be performed stably.

According to the invention, even in the environment of high humidity, when the recording medium 4 passes through the fixing device 1, it is possible to prevent the generation of such charges as to curl the recording medium 4 around the pressure roller 2. Further, stable fixing is thus performed in the fixing device. According to the invention, it is possible to obtain the heating roller or the pressure roller well-balanced in heat resistance, life, surface lubrication and the other respects.

Though the described respective embodiments deal with the case where a fixing rotatable member for the heat fixing device is a heating roller or a pressure roller, the fixing rotatable member is not limited to an illustrated roller, but it may be applied to a belt-like fixing rotatable member such as a fixing belt.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A fixing rotatable member for a heat fixing device comprising:

a base member; and a surface layer formed on an outer surface of the base member, having a surface resistivity of at most $1\times10^{16}\Omega$ and having a residual elongation percentage of at most 3%.

2. The fixing rotatable member according to claim 1, wherein the surface layer contains a dimethyl silicone rubber or a phenyl modified silicone rubber as elastic material.

3. The fixing rotatable member according to claim 1, wherein the surface layer contains a wet-type silica.

4. The fixing rotatable member according to claim 1, wherein the surface layer is impregnated with silicone oil.

5. The fixing rotatable member according to claim 1, wherein the base member comprises a metallic core member and an elastic layer formed on an outer surface of the metallic core member.

6. The fixing rotatable member according to claim 5, wherein the elastic layer contains a silicone rubber or a fluorine-containing rubber as elastic material.

7. The fixing rotatable member according to claim 5, wherein the elastic layer comprises a first elastic layer containing a silicone rubber and a second elastic layer, containing a fluorine-containing rubber.

8. A heat fixing device comprising:

a first fixing rotatable member comprising a base member and a surface layer formed on an outer surface of the base member, the surface layer having a surface resistivity of at most $1\times10^{16}\Omega$ and having a residual elongation percentage of at most 3%; and a second fixing rotatable member disposed in contact with the first fixing rotatable member.

9. The heat fixing device according to claim 8, wherein the base member comprises a metallic core member and an elastic layer formed on an outer surface of the metallic core member.

10. A fixing rotatable member for a heat fixing device comprising:

a base member; and a surface layer formed on an outer surface of the base member and containing a dimethyl silicone rubber and a carbon black, an amount of the carbon black being 0.1 to 5% by weight relative to the dimethyl silicone rubber, and wherein the surface layer has a surface resistivity of $1\times10^{12}\Omega$ to $1\times10^{16}\Omega$.

11. The fixing rotatable member according to claim 10, wherein the surface layer contains a dry-type silica, a wet-type silica or a mixture thereof.

12. The fixing rotatable member according to claim 10, wherein the dimethyl silicone rubber is composed of a straight chain dimethyl polysiloxane terminated with vinyl groups as main component.

13. The fixing rotatable member according to claim 10, wherein the base member comprises a metallic core member and an elastic layer formed on an outer surface of the metallic core member.

14. A fixing rotatable member for a heat fixing device comprising:

a base member; and a surface layer formed on an outer surface of the base member and containing a dimethyl silicone rubber and a carbon black, an amount of the carbon black being 0.1 to 5% by weight relative to the dimethyl silicone rubber, and wherein the surface layer has a residual elongation percentage of at most 3%.

15. A heat fixing device comprising:

a first fixing rotatable member comprising a base member and a surface layer formed on an outer surface of the base member, the surface layer containing a dimethyl silicone rubber and a carbon black, an amount of the carbon black being 0.1 to 5% by weight relative to the dimethyl silicone rubber; and a second fixing rotatable member disposed in contact with the first fixing rotatable member, wherein the surface layer has a surface resistivity of $1\times10^{12}\Omega$ to $1\times10^{16}\Omega$.

16. The fixing rotatable member according to claim 15, wherein the base member comprises a metallic core member and an elastic layer formed on an outer surface of the metallic core member.

17. A heat fixing device comprising:

a first fixing rotatable member comprising a first base member and a first surface layer formed on an outer surface of the first base member, the first surface layer containing an additive and a first dimethyl silicone rubber composed of a straight chain dimethyl polysiloxane terminated with vinyl groups as main component; and a second fixing rotatable member disposed in contact with the first fixing rotatable member and comprising a second base member and a second surface layer formed on an outer surface of the second base member, the second surface layer containing the additive and a second dimethyl silicone rubber composed of the straight chain dimethyl polysiloxane terminated with vinyl groups as main component;

wherein an amount of the additive of the first surface layer is larger than that of the second surface layer.

18. The heat fixing device according to claim 17, wherein the first fixing rotatable member is equipped with a heater therein.

19. The heat fixing device according to claim 17, wherein the additive is a carbon black.

20. The heat fixing device according to claim 17, wherein the additive is a wet-type silica.

21. A heat fixing device comprising:

a first fixing rotatable member comprising a first base member and a first surface layer formed on an outer surface of the first base member, the first surface layer containing a wet-type silica and a first dimethyl silicone rubber composed of a straight chain dimethyl polysiloxane terminated with vinyl groups as main component; and a second fixing rotatable member disposed in contact with the first fixing rotatable member and comprising a second base member and a second surface layer formed on an outer surface of the second base member, the second surface layer containing a dry-type silica and a second dimethyl silicone rubber composed the straight chain dimethyl polysiloxane terminated with vinyl groups as main component;

wherein an amount of an additive in the first surface layer is larger than that in the second surface layer.

22. The heat fixing device according to claim 21, wherein the first fixing rotatable member is equipped with a heater therein.

23. A heat fixing device comprising:

a first fixing rotatable member comprising a first base member and a first surface layer formed on an outer surface of the first base member, the first surface layer containing a first dimethyl silicone rubber composed of a straight chain dimethyl polysiloxane terminated with vinyl groups as main component; and a second fixing rotatable member disposed in contact with the first fixing rotatable member and comprising a second base member and a second surface layer formed on an outer surface of the second base member, the second surface layer containing a second dimethyl silicone rubber composed of the straight chain dimethyl polysiloxane terminated with vinyl groups as main component;

wherein a residual elongation percentage of the first surface layer is smaller than that of the second surface layer.

24. The heat fixing device according to claim 23, wherein the first fixing rotatable member is equipped with a heater therein.

* * * * *